US010258816B2

(12) United States Patent
Yabushita et al.

(10) Patent No.: US 10,258,816 B2
(45) Date of Patent: Apr. 16, 2019

(54) INJECTION HEAD HAVING SILENCING FUNCTION FOR GAS-TYPE FIRE EXTINGUISHER

(71) Applicant: Koatsu Co., Ltd., Hyogo (JP)

(72) Inventors: Masahiro Yabushita, Hyogo (JP); Yasufumi Inoue, Hyogo (JP)

(73) Assignee: Koatsu Co., Ltd., Hyogo (JP)

( * ) Notice: Subject to any disclaimer, the term of this patent is extended or adjusted under 35 U.S.C. 154(b) by 192 days.

(21) Appl. No.: 14/004,945

(22) PCT Filed: Feb. 12, 2013

(86) PCT No.: PCT/JP2013/053194
§ 371 (c)(1),
(2) Date: Sep. 27, 2013

(87) PCT Pub. No.: WO2013/125383
PCT Pub. Date: Aug. 29, 2013

(65) Prior Publication Data

US 2014/0069663 A1 Mar. 13, 2014

(30) Foreign Application Priority Data

Feb. 21, 2012 (JP) ..... 2012-035095
Mar. 21, 2012 (JP) ..... 2012-063472

(51) Int. Cl.
*B05B 1/00* (2006.01)
*A62C 31/02* (2006.01)

(52) U.S. Cl.
CPC ..... *A62C 31/02* (2013.01); *B05B 1/002* (2018.08)

(58) Field of Classification Search
CPC ..... A62C 35/68; A62C 35/62; A62C 31/02; A62C 35/023; A62C 5/022; A62C 35/00;
(Continued)

(56) References Cited

U.S. PATENT DOCUMENTS 7,587,969 B2 * 9/2009 Silvers ..... 89/14.4
2008/0078563 A1 * 4/2008 Hock et al. ..... 169/49
(Continued)

FOREIGN PATENT DOCUMENTS

EP 1 151 800 11/2001
JP 2011-125673 6/2011
(Continued)

OTHER PUBLICATIONS

International Search Report (ISR) dated Mar. 12, 2013 in International PCT Application No. PCT/JP2013/053194.

*Primary Examiner* — Jason J Boeckmann
(74) *Attorney, Agent, or Firm* — Wenderoth, Lind & Ponack, L.L.P.

(57) ABSTRACT

An injection head includes a silencing unit installed for releasing a fire-extinguishing gas in a fire-extinguishing area in the gas type fire extinguisher using a fire-extinguishing gas. The silencing unit includes silencing members of block shapes made of a porous material capable of passing a gas disposed at an outlet of an orifice. A first end face of the silencing member is disposed in contact with the injector head main body, while a peripheral face and a second end face of the silencing member are opened to the atmosphere except for the portion contacting a ring member for fixing the silencing member to the injection head main body by a bolt.

10 Claims, 21 Drawing Sheets

(58) Field of Classification Search
CPC ..... A62C 37/04; A62C 3/00; A62C 3/002; A62C 13/02; A62C 13/64; A62C 37/10; B05B 1/267; B05B 1/265; B05B 1/14; B05B 1/00; B05B 1/26; B05B 15/001; B05B 1/002; F01N 13/1894; F01N 2450/24; F01N 1/082
USPC ..... 169/37, 11
See application file for complete search history.

(56) References Cited

U.S. PATENT DOCUMENTS

| | | | | |
|---|---|---|---|---|
| 2009/0266643 | A1* | 10/2009 | Fukano et al. | 181/258 |
| 2011/0139469 | A1* | 6/2011 | Garrett et al. | 169/46 |
| 2012/0205128 | A1* | 8/2012 | Goto | 169/11 |
| 2013/0292140 | A1* | 11/2013 | Inoue et al. | 169/11 |

FOREIGN PATENT DOCUMENTS

| | | | |
|---|---|---|---|
| JP | 2011-255152 | | 12/2011 |
| WO | WO 2011049002 | A1 * | 4/2011 |

* cited by examiner

INJECTION HEAD HAVING SILENCING FUNCTION FOR GAS-TYPE FIRE EXTINGUISHER

TECHNICAL FIELD

The present invention relates to a gas-type fire extinguisher using a fire-extinguishing gas such as nitrogen, carbon dioxide, or fluorine compound, and more particularly to an injection head installed on a ceiling or wall for releasing fire-extinguishing gas to a fire-extinguishing area, and specifically to an injection head having a silencing function for gas-type fire extinguisher capable of reducing noise generated at the time of emission of fire-extinguishing gas.

PRIOR ART

In a gas-type fire extinguisher using a fire-extinguishing gas such as nitrogen, carbon dioxide, or fluorine compound, when the gas-type fire extinguisher is put in operation for extinguishing a fire, the fire-extinguishing gas is released so that the fire-extinguishing gas concentration in the fire-extinguishing area may reach a fire-extinguishing concentration within about a minute (about 10 seconds in the case of fire-extinguishing gas of fluorine compound).

At this time, the fire-extinguishing gas is released from an injection head installed in a ceiling or wall for releasing fire-extinguishing gas to a fire-extinguishing area, but the injection head for a gas-type fire extinguisher includes, as shown in FIG. 13 (*a*), an orifice 20 at an outlet of an injection head 10A connected to a piping 40 for supplying a fire-extinguishing gas, for releasing the fire-extinguishing gas to a fire-extinguishing area from the orifice 20, or includes, as shown in FIG. 13 (*b*), an orifice 20 and a conical deflector (deflecting member) 50 at an outlet of an injection head 10B connected to a piping 40 for supplying a fire-extinguishing gas, for releasing the fire-extinguishing gas released from the orifice to a fire-extinguishing area by deflecting by the deflector (deflecting member) 50, or further includes, as shown in FIG. 13 (*c*), an orifice (not shown) and a conical tubular horn (dispersion member) 60 at an outlet of an injection head 10C, for releasing the fire-extinguishing gas to the fire-extinguishing area by diffusing by the horn (diffusion member) 60, which have been used conventionally.

Thus, the conventional gas-type fire extinguisher injection heads 10A, 10B, and 10C are designed to release the same amount of fire-extinguishing gas from individual injection heads usually installed in a plurality in the fire-extinguishing area. Therefore, the flow rate of fire-extinguishing gas released from the injection heads is limited by the orifice 20. Hence, at the time of emission of fire-extinguishing gas from the injection heads, noise of high level (specifically noise of over about 120 dB) is generated.

At the time of operation of the gas-type fire extinguisher, it is supposed no one exits in the fire-extinguishing area, conventionally, no problem has been considered about the noise (vibration) generated at the time of emission of fire-extinguishing gas, and no countermeasures have been taken.

Recently, however, in consideration of the case some one is left over in the fire-extinguishing area at the time of operation of the gas-type fire extinguisher, or adverse effects on the surrounding people of the noise source at the time of emission of fire-extinguishing gas from the injection heads, and the possibility noise (vibration) causing troubles in the precision machines such as information communication devices, it has been proposed to reduce the noise generated at the time of emission of fire-extinguishing gas (see, for example, patent literature 1 to 3).

PRIOR ART LITERATURE

Patent Literature

[Patent Literature 1] Japanese Patent Application Laid-Open No. 2011-115255

[Patent Literature 2] Japanese Patent Application Laid-Open No. 2011-125673

[Patent Literature 3] Japanese Patent Application Laid-Open No. 2011-255152

Therefore, in order to solve the problems caused by noise (including vibration) (hereinafter simply called noise) generated at the time of emission of fire-extinguishing gas from the injection heads, among the above technologies, the technology disclosed in patent literature 1 is intended to match the starting timing of the fire extinguisher and the avoid remedy timing for preventing malfunction of the ICT device due to starting of the fire extinguisher when starting up the fire extinguisher, and it is not intended to lower the noise level.

On the other hand, the technologies disclosed in patent literature 2 and 3 is intended to lower the noise level, but a large size is needed for injection heads, there are problems in the aspects of limitation of place of installation and the cost increase.

In this kind of injection heads, moreover, a large injection reaction of the fire-extinguishing gas is applied to the injection heads at the time of release of fire-extinguishing gas, a sufficient supporting force is needed in the structure for accommodating the injection heads and pipes, and in this aspect, too, there are problems in the limitation of place of installation and the cost increase.

SUMMARY OF THE INVENTION

The invention is devised in the light of the problems of the conventional gas type fire-extinguisher injection heads. Thus, a primary object thereof is to present a gas-type fire-extinguisher injection head by using small-sized injection heads, capable of enhancing the noise reducing rate, and suppressing the injection pressure of fire-extinguishing gas applied to the injection heads at the time of emission of fire-extinguishing gas.

To achieve the object, a first aspect of the invention relates to an injection head having a silencing function for gas-type fire extinguisher, more particularly to an injection head having silencing unit installed for releasing a fire-extinguishing gas in a fire-extinguishing area in the gas type fire extinguisher using a fire-extinguishing gas. The silencing unit is composed of silencing members of block shapes made of a porous material capable of passing a gas disposed at an outlet of the orifice, and a first end face of the silencing member is disposed in contact with the injector head main body. A peripheral face and a second end face of the silencing member are opened to the atmosphere except for the portion contacting with a ring member for fixing the silencing member to the injection head main body by way of a bolt.

In this case, the bolt penetrates through the inside of the silencing member and is screwed into the injection head main body.

The portion of the silencing member through which the bolt penetrates can be formed in a shape swollen to the outer peripheral side than other positions.

In the injection head main body contacting with one-side end face of the silencing member, an orifice plate forming an orifice may be disposed detachably.

The small-end side of the orifice may face the silencing member.

The diameter of pores of the silencing member porous material for composing the silencing member may be formed smaller in a direction of passing of the gas.

Injection reaction F of fire-extinguishing gas applied on the injection head at the time of emission of fire-extinguishing gas and flow rate Q of the fire-extinguishing gas released from the injection head may be adjusted to satisfy the relation of formula 1 and formula 2.

$$F\ (\text{kgf}) = A\ (\text{kgf}\cdot\text{min}/\text{m}^3)\cdot Q\ (\text{m}^3/\text{min}) \quad \text{(formula 1)}$$

$$A\ (\text{kgf}\cdot\text{min}/\text{m}^3) \leq 0.2 \quad \text{(formula 2)}$$

To achieve the object, a second aspect of the invention relates to an injection head having a silencing function for gas-type fire extinguisher, more particularly to an injection head having silencing unit installed for releasing a fire-extinguishing gas in a fire-extinguishing area in the gas type fire extinguisher using a fire-extinguishing gas. The silencing unit is composed of silencing members of block shapes made of a porous material capable of passing a gas disposed at an outlet of the orifice. A one-side end face of the silencing member released to the atmosphere is supported on an injection head main body by way of a bolt contacting with a ring member contacting with a peripheral portion of the end face and a bolt contacting with a central part of the end face.

In this case, an orifice plate forming an orifice is detachably disposed in an injection head main body contacting with an other-side end face of the silencing member, and the bolt is screwed into the orifice plate.

The small-end side of the orifice may face the silencing member.

The diameter of pores of the silencing member porous material for composing the silencing member may be formed smaller in a direction of passing of the gas.

Effects of the Invention

According to the injection head having the silencing function for the gas-type fire extinguisher of the present invention, the silencing unit is composed of silencing members of block shapes made of a porous material capable of passing a gas disposed at an outlet of the orifice, and a first end face of the silencing member is disposed in contact with the injection head main body. A peripheral portion and a second end face of the silencing member are released to the atmosphere except for the portion contacting with a ring member fixing the silencing member to the injection head main body by way of a bolt. Therefore, the emission area of fire-extinguishing gas released to the atmosphere of the silencing member is increased, and the noise reduction rate is higher. Moreover, the injection reaction of fire-extinguishing gas applied to the injection head at the time of emission of fire-extinguishing gas is canceled by the portion of the fire-extinguishing gas emitted from the surrounding of the silencing member in the injection head unit, and can be decreased. As a result, the injection head can be reduced in size, and the required supporting force of the building accommodating the piping system including the injection head can be reduced, and the problems of limitations of place of installation and the cost increase can be eliminated.

The bolt penetrates through the inside of the silencing member and is screwed into the injection head main body. Therefore, the emission area of fire-extinguishing gas released to the atmosphere of the silencing member is increased more, and the noise reduction rate can be heightened, and it is also effective to suppress generation of noise caused by interference of the released fire-extinguishing gas with the bolt.

The portion of the silencing member through which the bolt penetrates is formed in a shape swollen further to the outer peripheral side than other positions. Therefore, the emission area of fire-extinguishing gas released to the atmosphere of the silencing member is increased more, and the noise reduction rate can be heightened.

In the injection head main body contacting with one-side end face of the silencing member, an orifice plate forming an orifice is disposed detachably. Therefore, the orifice plate forming plural types of orifices can be selected depending on the condition.

The small-end side of the orifice faces the silencing member, and therefore the fire-extinguishing gas can be distributed uniformly from the central part of the silencing member to the peripheral parts, and the noise generated in the emission zone of fire-extinguishing gas can be made uniform, and together the noise reduction rate can be heightened further.

The diameter of pores of the porous material is formed smaller in a direction of passing of the gas, and therefore the fire-extinguishing gas is emitted uniformly from parts of the silencing member, and the noise generated in the emission zone of fire-extinguishing gas can be made uniform, and together the noise reduction rate can be heightened further.

Injection reaction F of fire-extinguishing gas applied on the injection head at the time of emission of fire-extinguishing gas and flow rate Q of the fire-extinguishing gas released from the injection head can be adjusted to satisfy the relation of formula 1 and formula 2, and therefore the required supporting force of the building accommodating the piping system including the injection head can be reduced, and the problems of limitations of place of installation and the cost increase can be eliminated.

According to the injection head having a silencing function for gas-type fire extinguisher of the present invention, the silencing unit is composed of silencing members of block shapes made of a porous material capable of passing a gas disposed at an outlet of the orifice, and a one-side end face of the silencing member released to the atmosphere is supported on an injection head main body by way of a bolt contacting with a ring member contacting with a peripheral portion of the end face and a bolt contacting with a central part of the end face. Therefore, the silencing member can be firmly strained and supported on the injection head main body, and the passing resistance of the fire-extinguishing gas is large, and the silencing member high in silencing performance per unit volume can be used, and the noise reduction rate is enhanced. As a result, the injection head can be reduced in size, and the problems of limitations of place of installation and the cost increase can be eliminated.

An orifice plate forming an orifice is detachably disposed in an injection head main body contacting with an other-side end face of the silencing member, and the bolt is screwed into the orifice plate, and therefore the orifice plate forming plural types of orifices can be selected depending on the condition.

The small-end side of the orifice faces the silencing member, and therefore the fire-extinguishing gas can be distributed uniformly from the central part of the silencing member to the peripheral parts, and the noise generated in the emission zone of fire-extinguishing gas can be made uniform, and together the noise reduction rate can be heightened further.

The diameter of pores of the silencing member porous material for forming the silencing member is formed smaller in a direction of passing of the gas. Therefore, the fire-extinguishing gas is emitted uniformly from parts of the silencing member, and the noise generated in the emission zone of fire-extinguishing gas can be made uniform, and together the noise reduction rate can be heightened further.

DETAILED DESCRIPTION OF THE INVENTION

Figure 1:
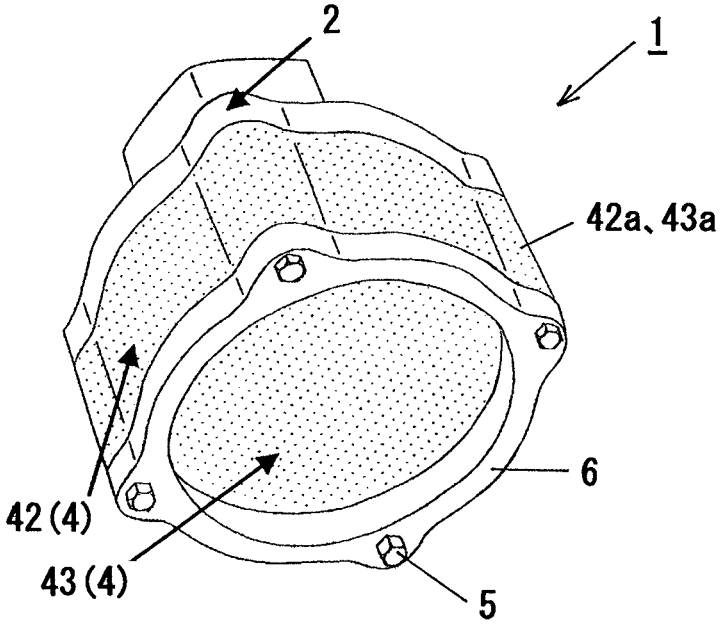
FIG. 1 is a perspective view as seen obliquely from bottom showing a first embodiment of an injection head having a silencing function for gas-type fire extinguisher of the present invention.
Figure 2:
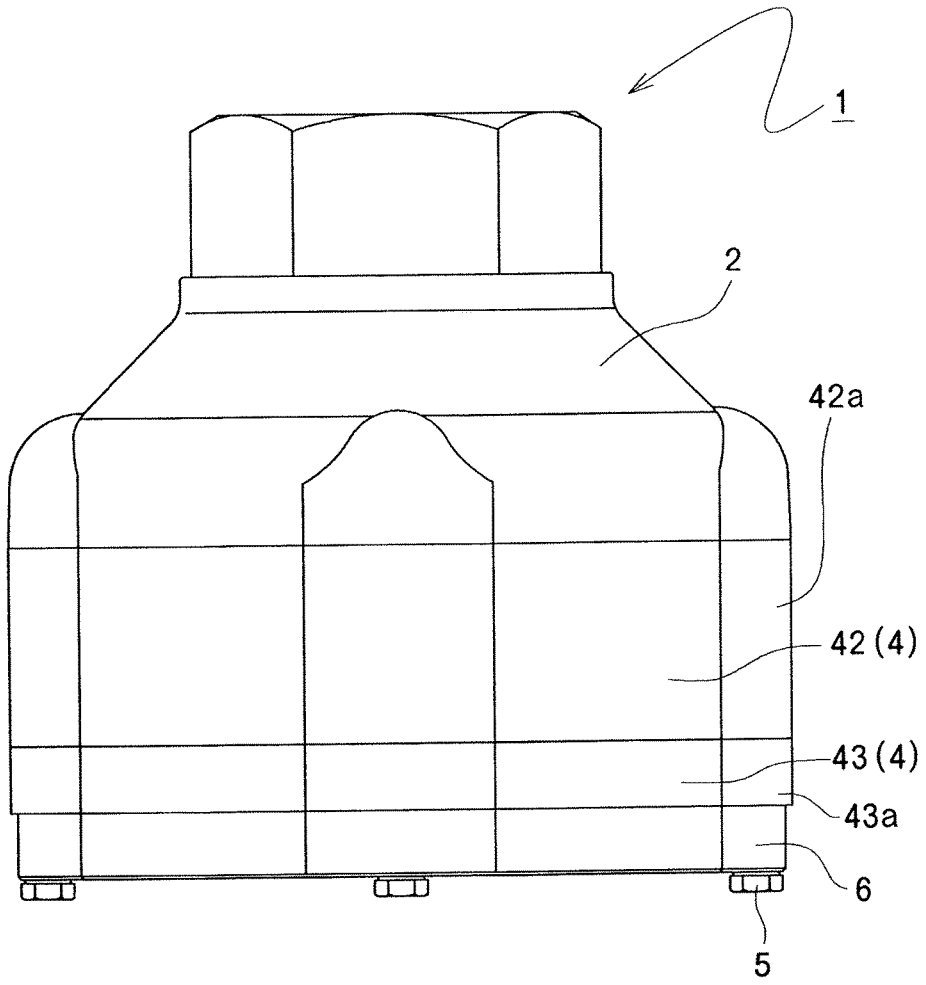
FIG. 2 is a front view of the same.
Figure 3:
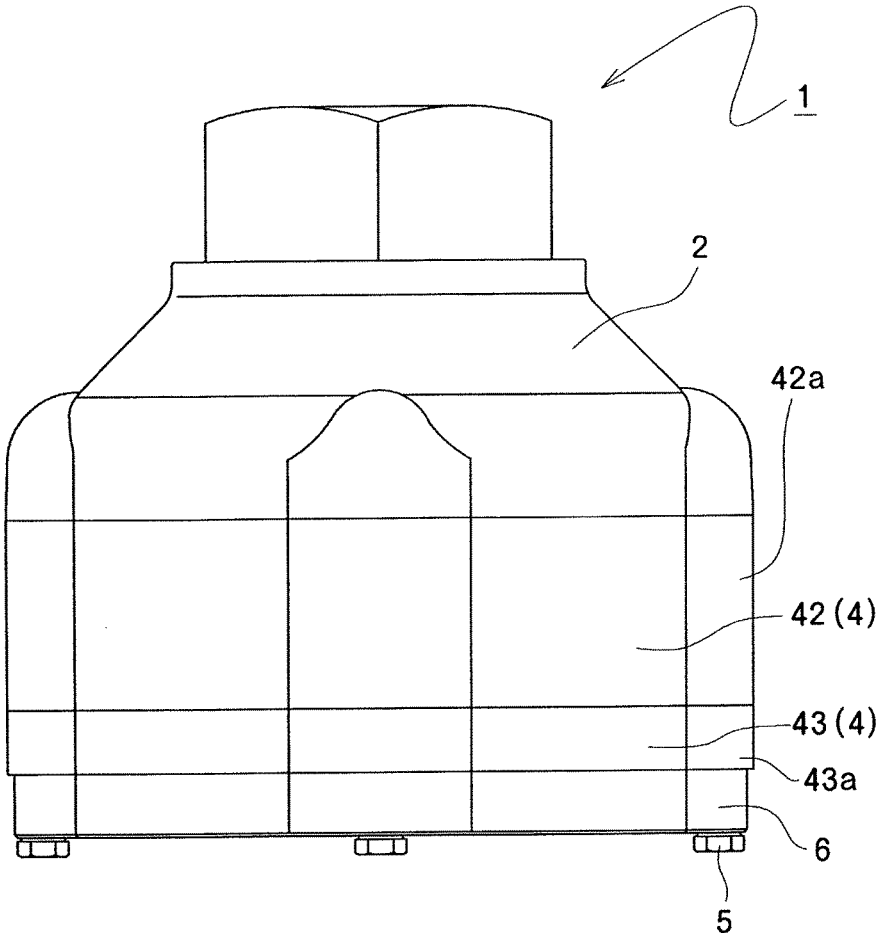
FIG. 3 is a left side view of the same.

An embodiment of an injection head having a silencing function for a gas-type fire extinguisher of the present invention is described below by reference to the accompanying drawings.

FIG. 1 to FIG. 6 show a first embodiment of an injection head having a silencing function for a gas-type fire extinguisher of the present invention.

The injection head 1 having a silencing function for a gas-type fire extinguisher is an injection head installed for releasing a fire-extinguishing gas to a fire-extinguishing area in the gas-type fire extinguisher using a fire-extinguishing gas, and includes an injection head main body 2 connected to a piping (not shown) for supplying an fire-extinguishing gas, an orifice plate 3 forming a plurality of orifices 31 detachably disposed on steps 21 formed in an internal space of the injection head main body 2 (see FIGS. 4 and 6), a silencing member 4 of block shapes formed of a porous material capable of passing a gas disposed at outlet of orifices 31, and a ring member 6 for fixing the silencing member 4 to the injection head main body 2 by way of bolts 5.

In this case, the orifice plate 3 forming the plurality of orifices 31 is disposed on the steps 21 formed in the internal space of the injection head main body 2, for example, by way of threads formed in the periphery of the step 21 and the orifice plate 3. Therefore, the orifice plate 3 is detachable, and the orifice plate 3 forming plural types of the orifices 31 can be selected according to the condition of the place of installation or the like.

Instead, by omitting the orifice plate 3, as shown in a second embodiment below, the orifices can be directly formed in the injection head main body 2.

The orifices 31 are preferably formed oppositely to the silencing member 4 at the small-end side (narrow end) 31*a* of the orifices 31.

Hence, by distributing the fire-extinguishing gas uniformly from the central parts of the silencing member 4 toward peripheral parts, the noise generated in the emission area of the fire-extinguishing gas can be made uniform, and the noise reduction rate can be further increased.

The silencing member 4 of block shapes formed on a porous material is an integral structure, or may be formed in split structures, as shown in the embodiment, composed of a central member 41, a peripheral member 42, and end members 43 for covering the end faces of the central member 41 and the peripheral member 42.

The porous material composing the silencing member 4 is preferably a sinter made of an inorganic material (metal, oxide of metal, hydroxide of metal, and others) high in shape retaining performance.

The pore diameter of pores of the porous material composing the silencing member 4 is made of a generally homogeneous material, or a material changed in the gas passing direction, or more particularly a material reduced in the gas passing direction. For example, in this embodiment, it is made of a material becoming smaller in the pore diameter of the pores of the peripheral material 42 and the end face material 43, than the pore diameter of pores of the central material.

Thus, the pore diameter of pores of the porous material composing the silencing member 4 is made smaller in the gas passing direction (i.e., direction of gas flow), and by releasing the fire-extinguishing gas uniformly from the parts of the silencing member 4, so that the noise generated from the emission area of the fire-extinguishing gas can be made uniform, and the noise reduction rate can be further enhanced.

The silencing member 4, whether in integral structure or in split structure, is disposed so that the one-end side of the silencing member 4 may contact with the injection head main body 2 (possibly including the orifice plate 3 in this embodiment), and the peripheral parts and other-end side face of the silencing member 4 are opened to the atmosphere, except for the portion contacting with the ring members 6 for fixing the silencing member 4 to the injection head main body 2 by way of the bolts 5.

As a result, it is possible to increase the emission area of the fire-extinguishing gas to be released to the atmosphere of the silencing member 4. Moreover, the injection reaction of fire-extinguishing gas applied to the injection head 1 at the time of emission of fire-extinguishing gas is canceled by the portion of the fire-extinguishing gas emitted from the surrounding of the silencing member 4 in the injection head 1, and can be decreased.

In this case, the bolt 5 penetrates through the silencing member 4, or in this embodiment, the inside of the peripheral member 42 and the end-face member 43, and is screwed into the injection head main body 2. Therefore, the silencing member 4 is facing the orifice plate 43, and is fixed and integrated to the injection head main body 2.

As a result, it is possible to further increase the emission area of the fire-extinguishing gas to be released to the atmosphere of the silencing member 4, and the noise reduction rate can be enhanced, and generation of noise due to interference of the released fire-extinguishing gas with the bolt 5 can be prevented.

Figure 4:
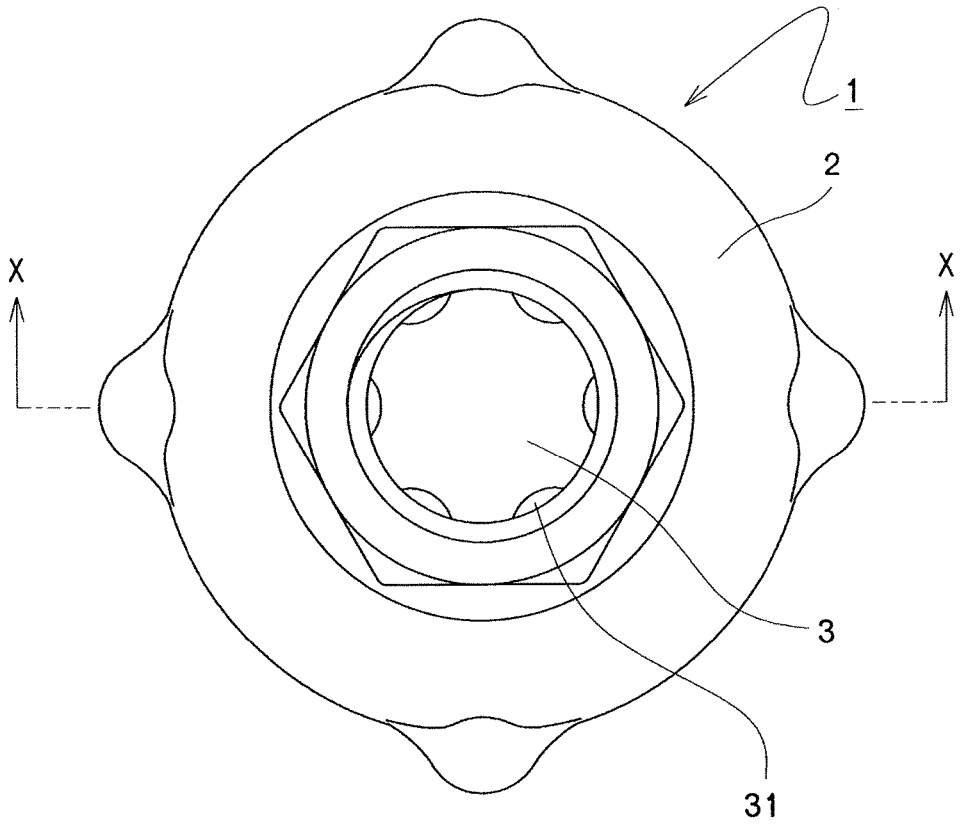
FIG. 4 is a plan view of the same.
Figure 5:
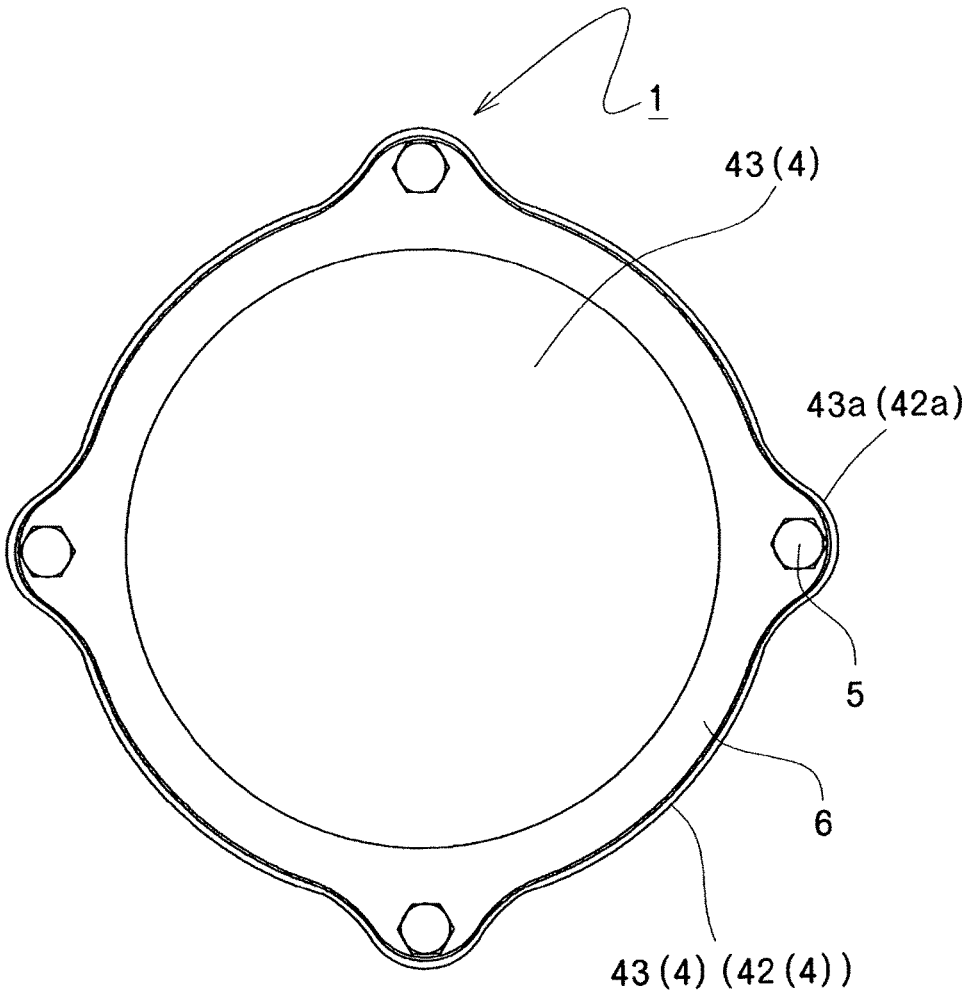
FIG. 5 is a bottom view of the same.
Figure 6:
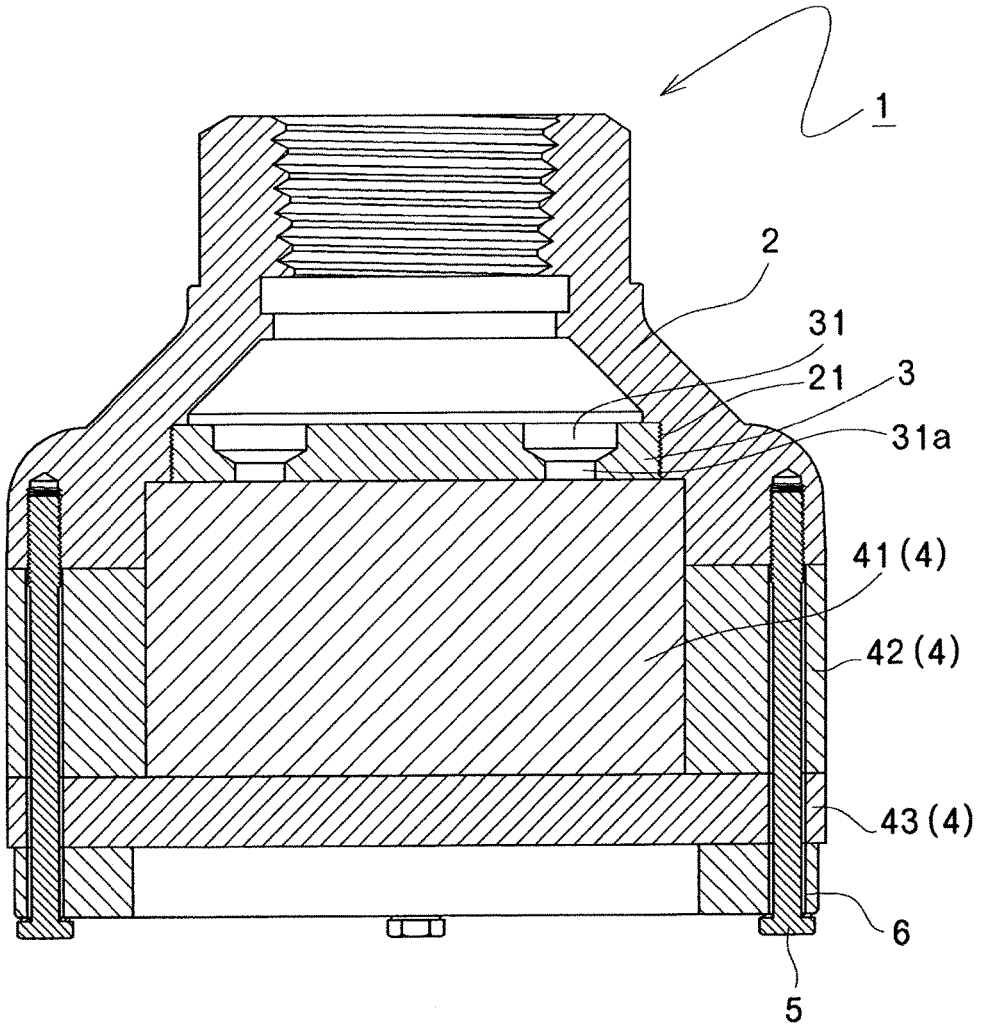
FIG. 6 is an X-X sectional view of FIG. 4.

In the embodiment, the position of the silencing member 4 through which the bolt 5 penetrates, or in the embodiment, positions 42*a*, 43*a* of the peripheral member 42 and end-face member 43 are formed in a shape swollen (protruding) to the outer peripheral side from the other positions. In other words, the bolt receiving portions 42*a*, 43*a* of the peripheral member 42 and end-face member 43 protrude further outwardly than a circumferential surface of the main portions of the peripheral member 42 and end-face member 43, as shown in FIGS. 1, 4 and 5.

As a result, it is possible to increase the emission area of the fire-extinguishing gas to be released to the atmosphere of the silencing member 4, and the noise reduction rate can be enhanced.

Still more, when the porous material for composing the silencing member 4 is formed by cutting out from a sinter plate, waste of the material can be saved by forming the member into the shape of the embodiment (a square-like shape).

In the injection head 1 of the embodiment, injection reaction F of fire-extinguishing gas applied on the injection head at the time of emission of fire-extinguishing gas and flow rate Q of the fire-extinguishing gas released from the injection head are defined to satisfy the relation of formula 1 and formula 2.

$$F\ (\text{kgf}) = A\ (\text{kgf}\cdot\text{min/m}^3)\cdot Q\ (\text{m}^3/\text{min}) \qquad \text{(formula 1)}$$

$$A\ (\text{kgf}\cdot\text{min/m}^3) \leq 0.2 \qquad \text{(formula 2)}$$

Where A is a constant determined by the type of the injection head and the fire-extinguishing gas. The value of A is preferably 0.15 or less, or more preferably 0.1 or less.

Figure 7:
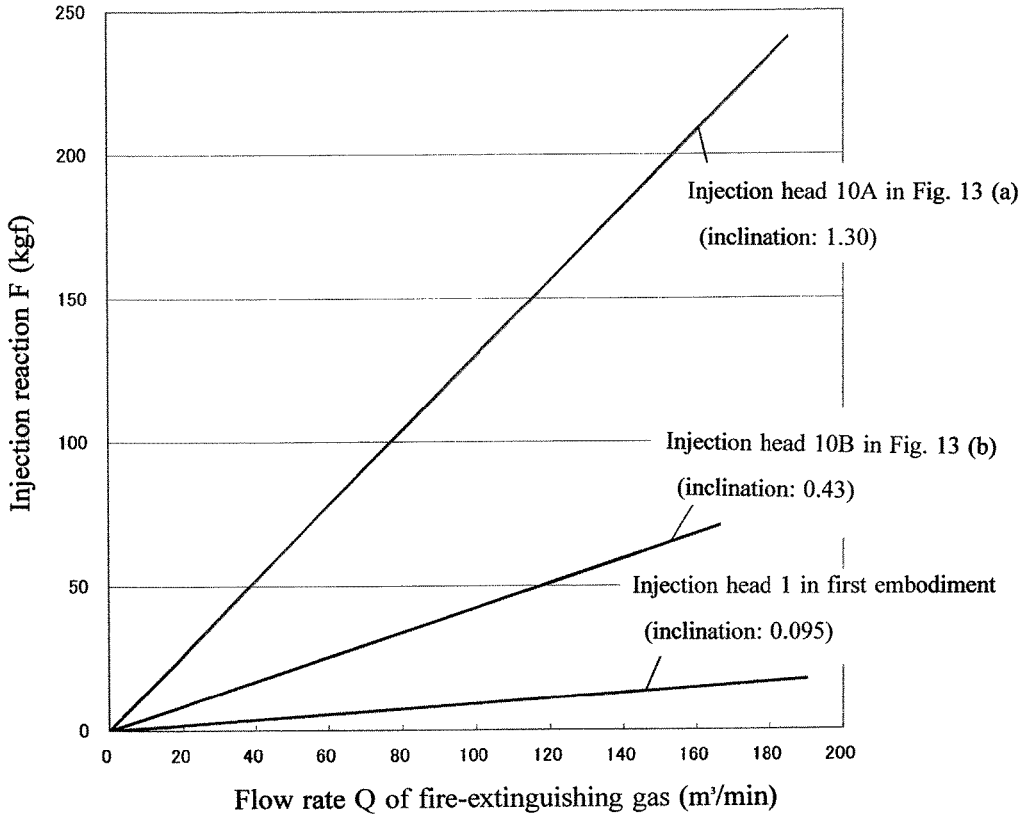
FIG. 7 is a graph showing the relation between injection reaction F of fire-extinguishing gas applied to the injection head when fire-extinguishing gas is released, and flow rate of fire-extinguishing gas released from the injection head.
Figure 8:
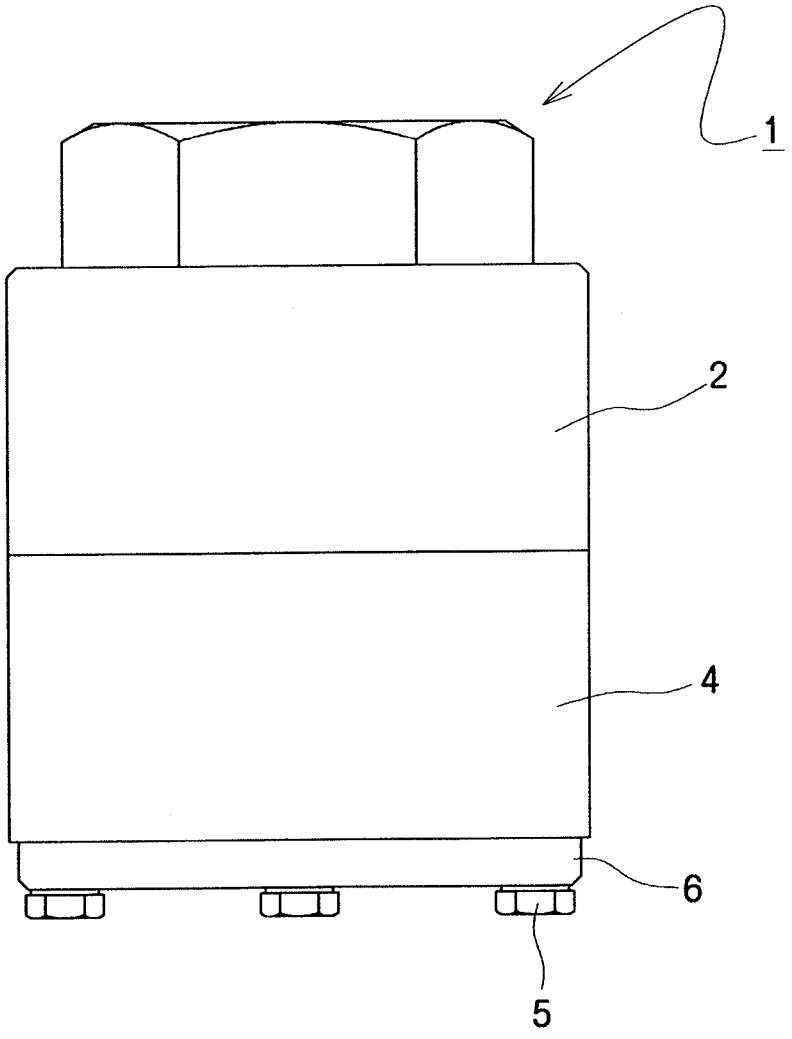
FIG. 8 is a front view of a second embodiment of an injection head having a silencing function for gas-type fire extinguisher of the present invention.
Figure 9:
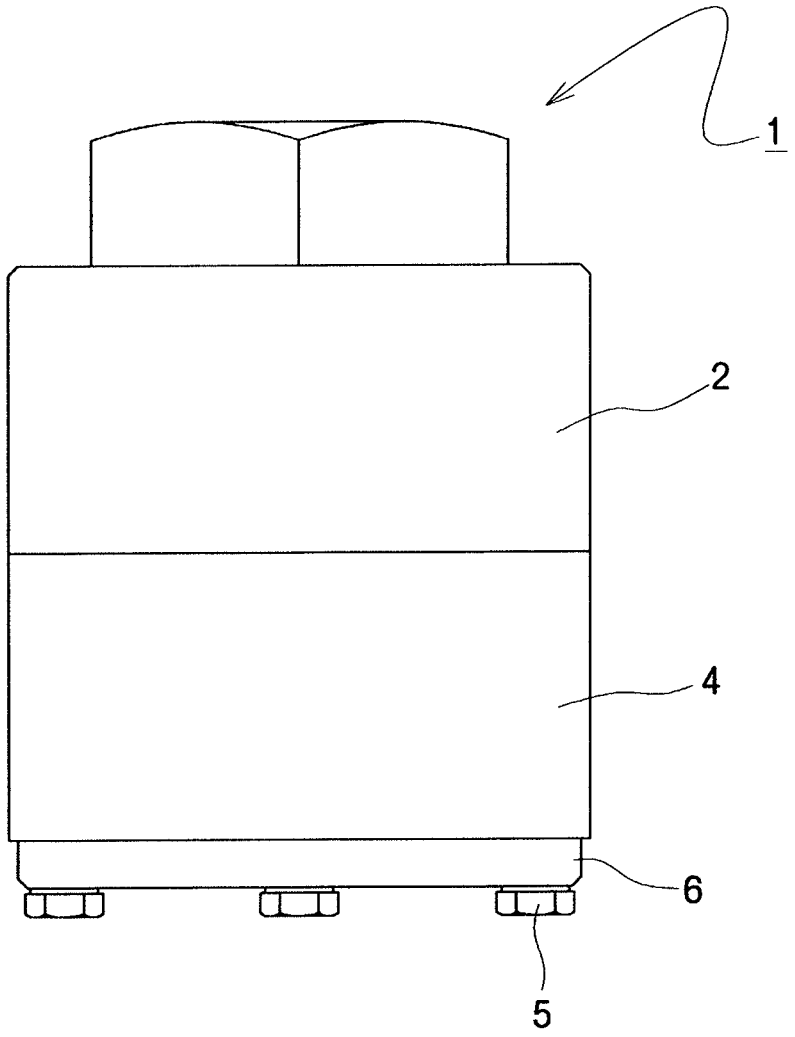
FIG. 9 is a left side view of the same.
Figure 10:
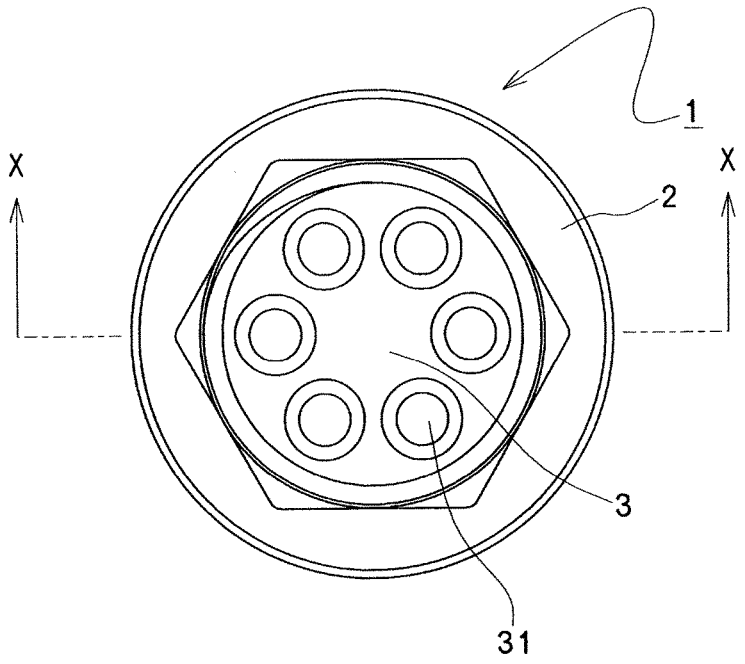
FIG. 10 is s plan view of the same.
Figure 11:
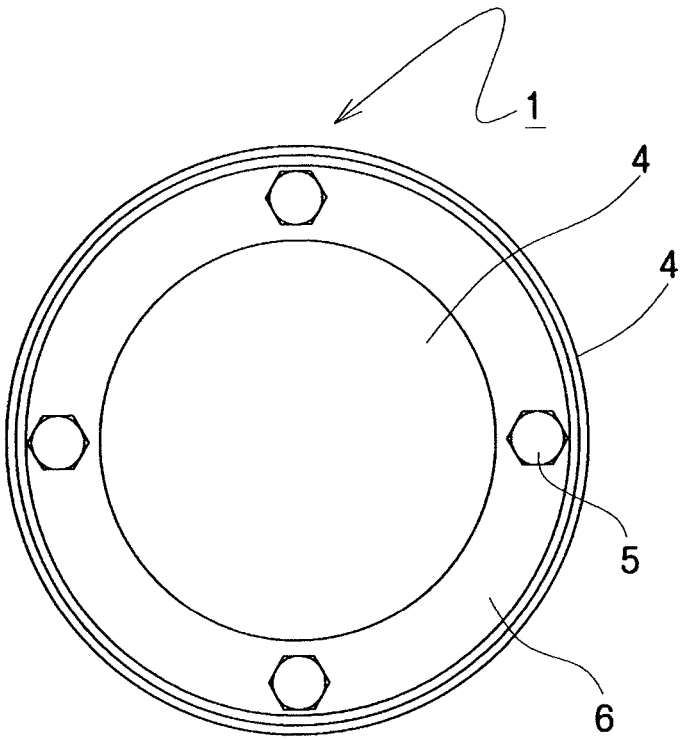
FIG. 11 is a bottom view of the same.
Figure 12:
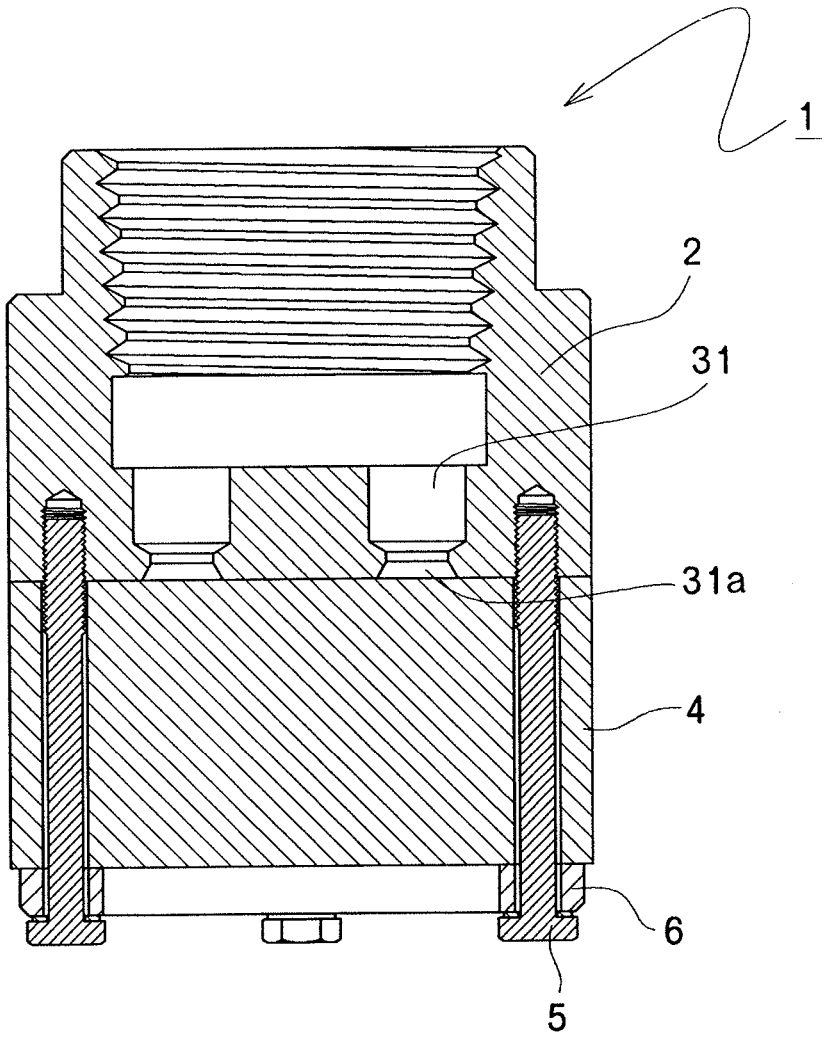
FIG. 12 is an X-X sectional view of FIG. 10.
Figure 13:
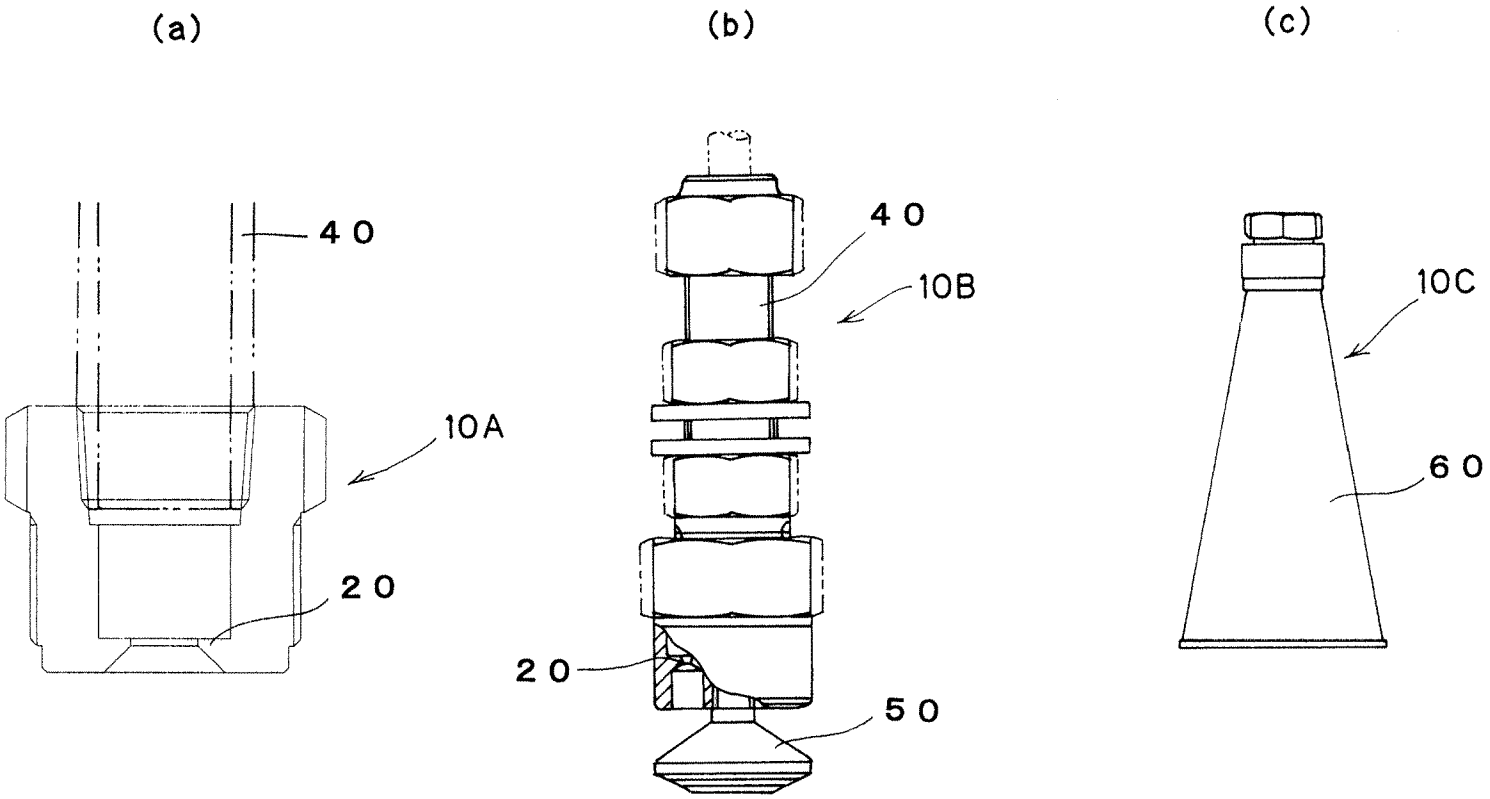
FIG. 13 is an explanatory diagram of an injection head for a conventional gas-type fire extinguisher.
Figure 14:
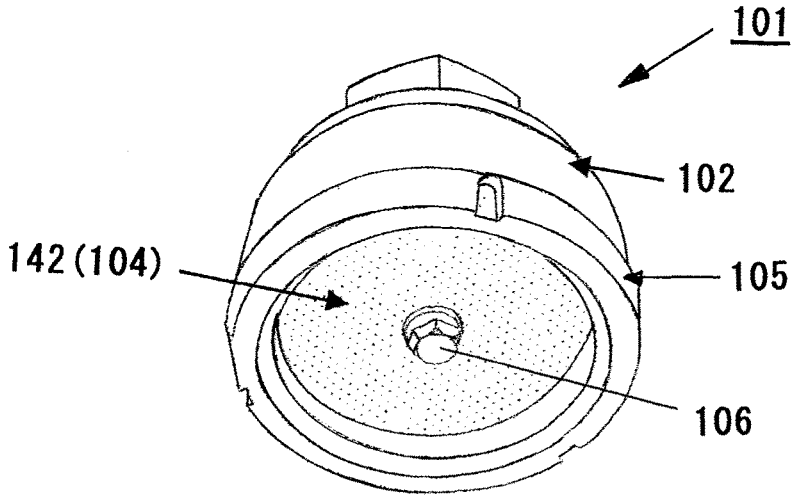
FIG. 14 is a perspective view as seen obliquely from bottom showing a third embodiment of an injection head having a silencing function for gas-type fire extinguisher of the present invention.
Figure 15:
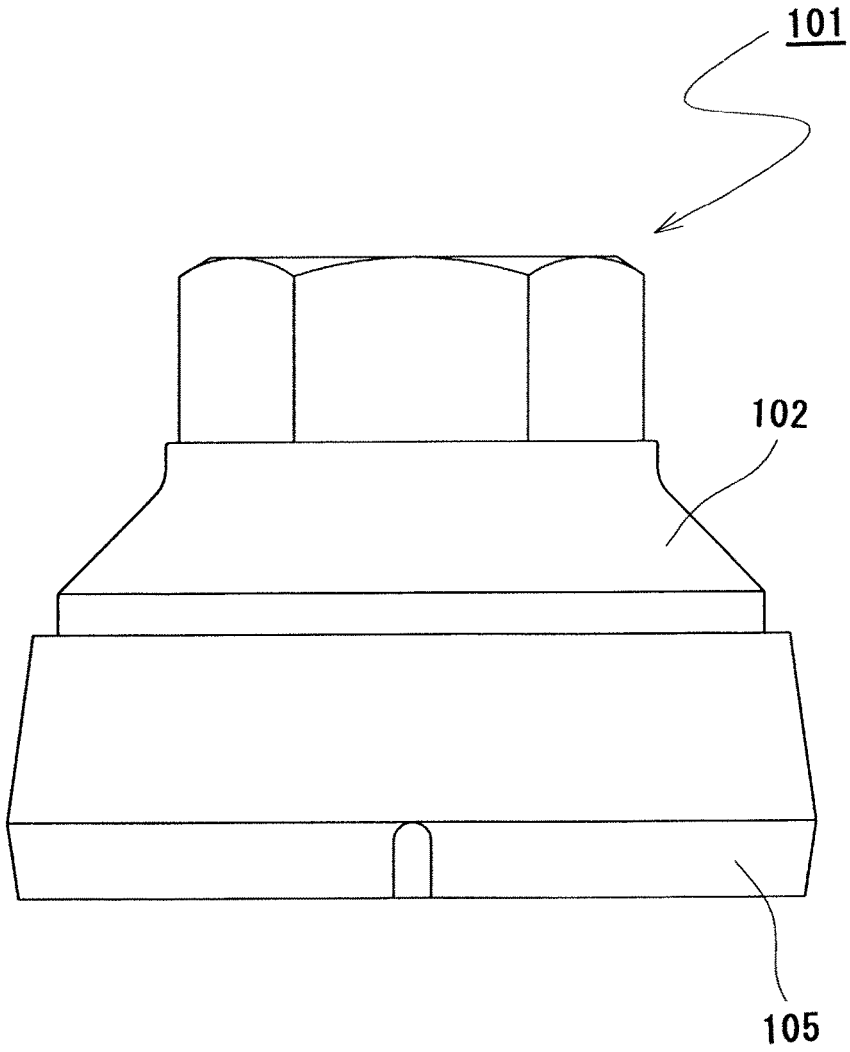
FIG. 15 is a front view of the same.
Figure 16:
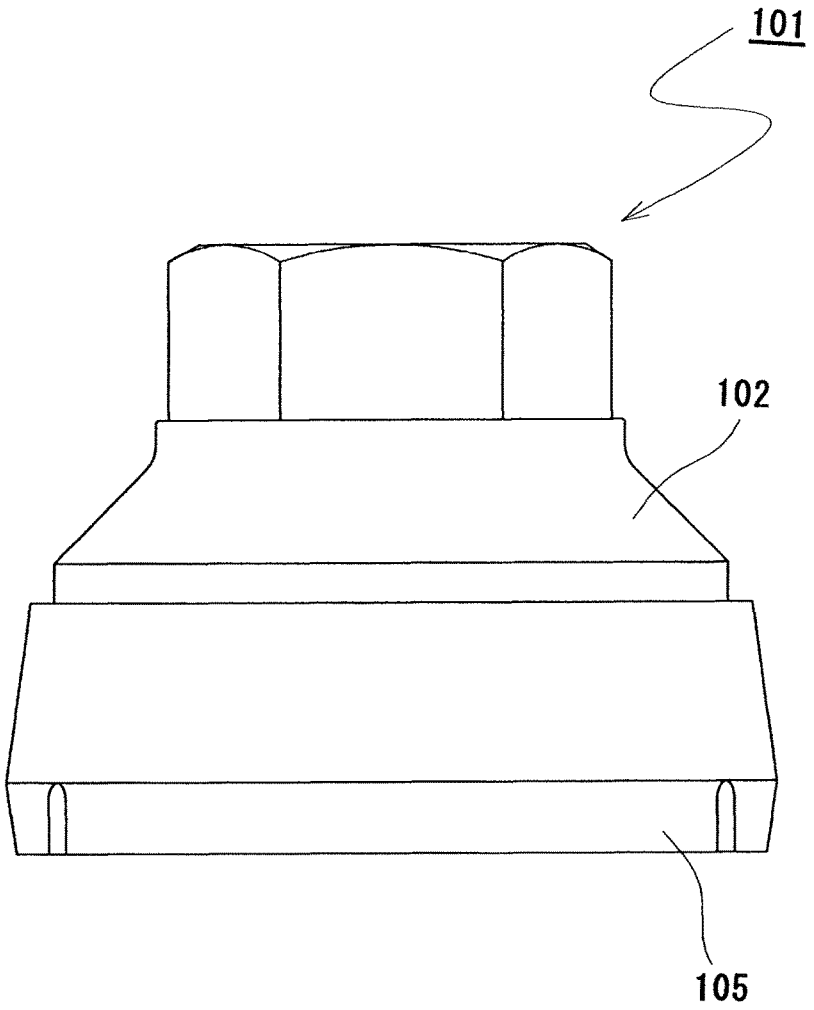
FIG. 16 is a back side view of the same.
Figure 17:
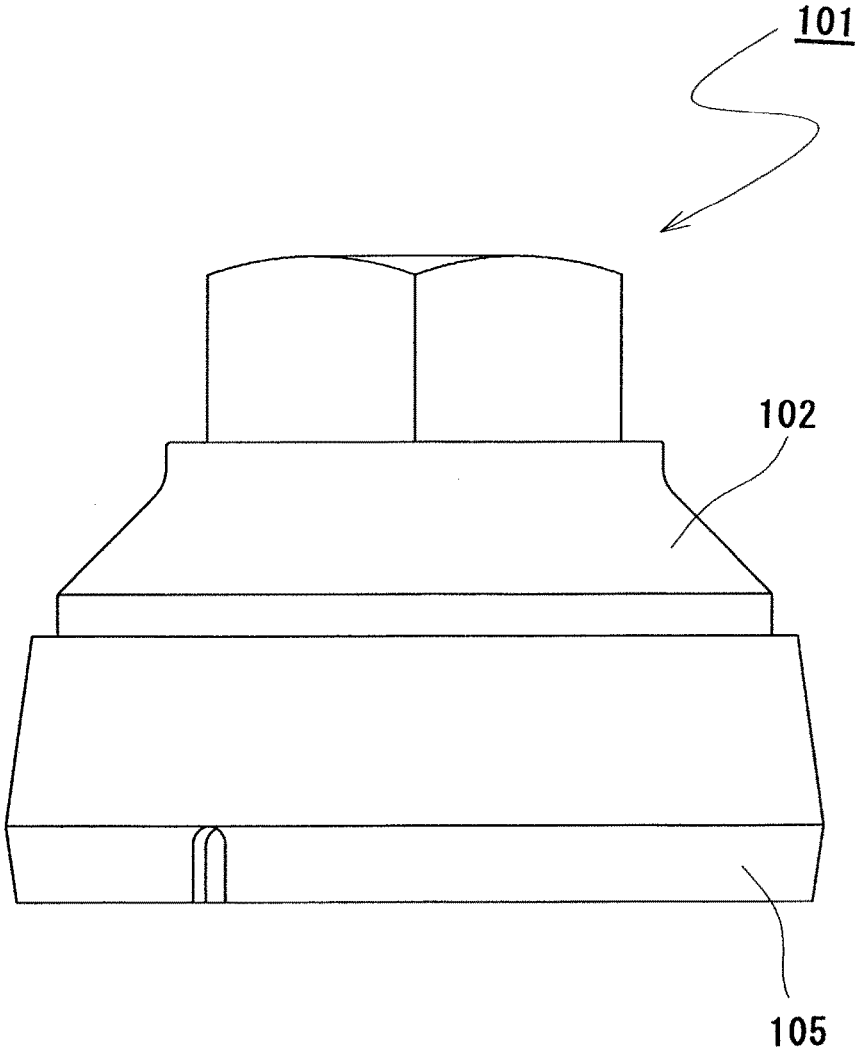
FIG. 17 is a left side view of the same.
Figure 18:
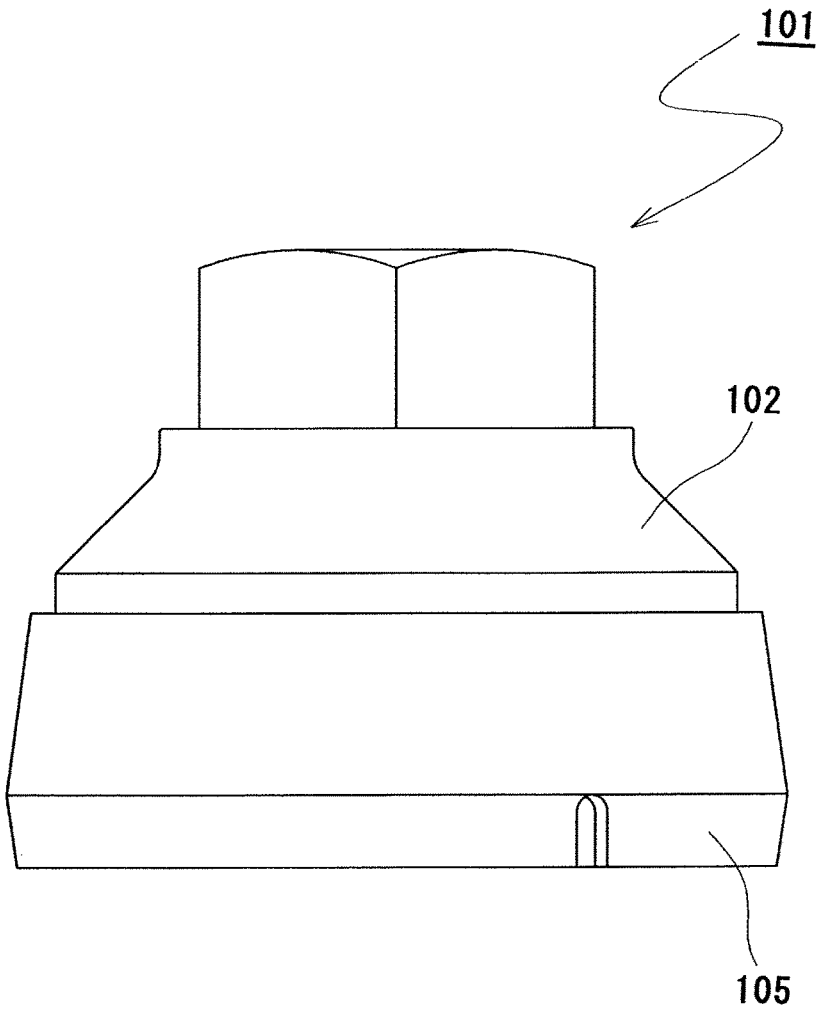
FIG. 18 is a right side view of the same.
Figure 19:
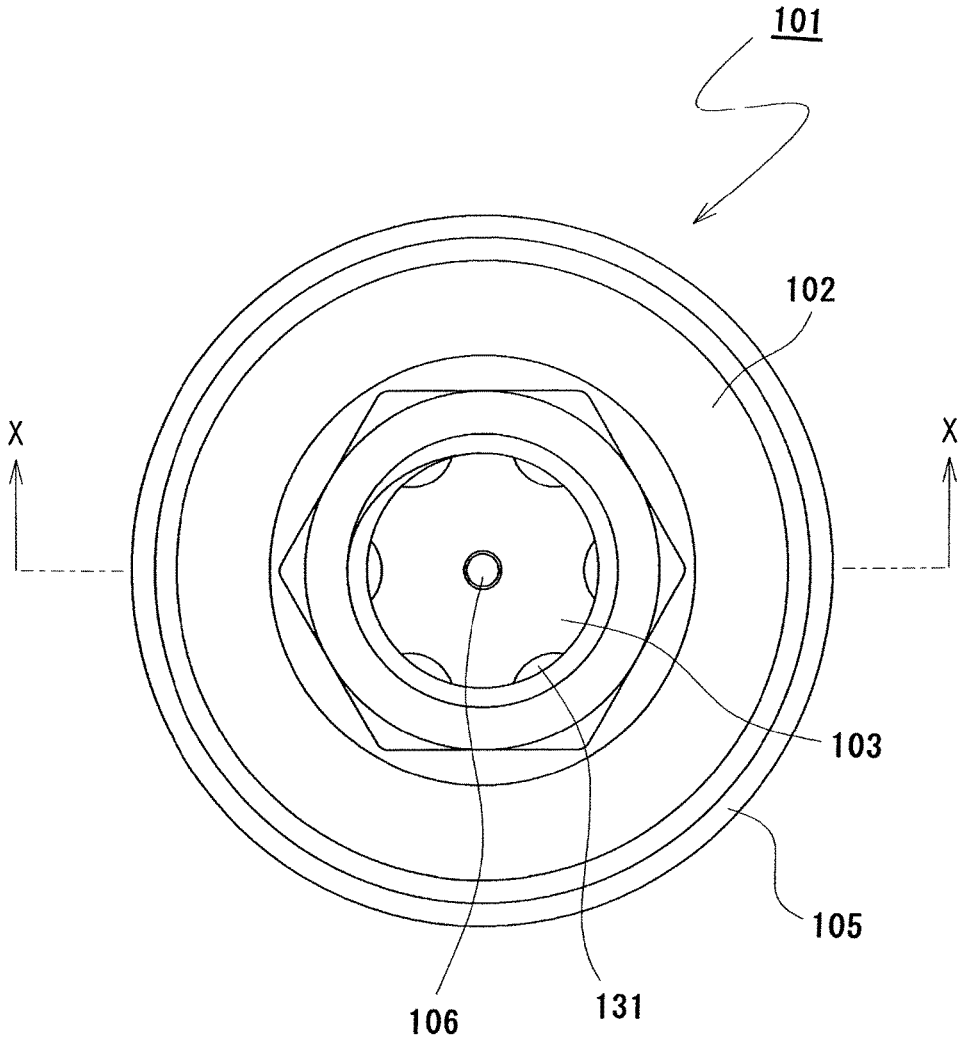
FIG. 19 is a plan view of the same.
Figure 20:
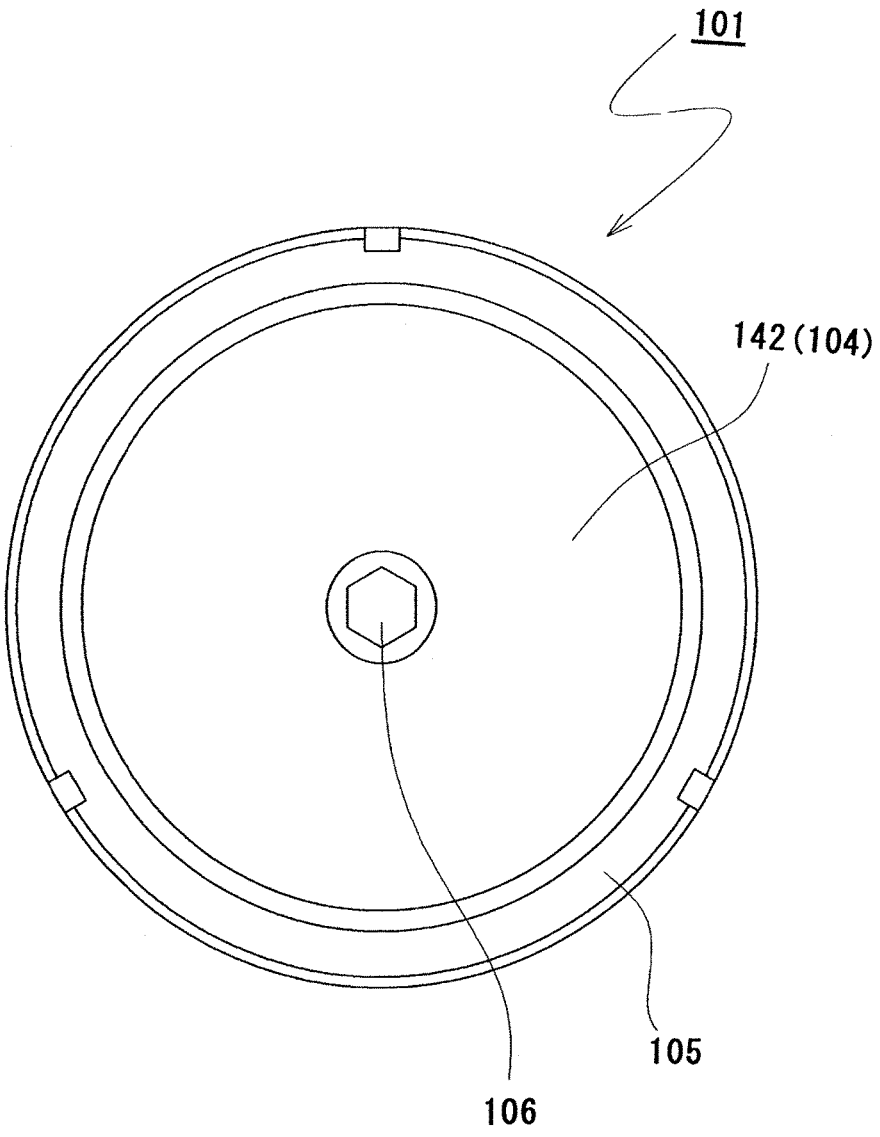
FIG. 20 is a bottom view of the same.
Figure 21:
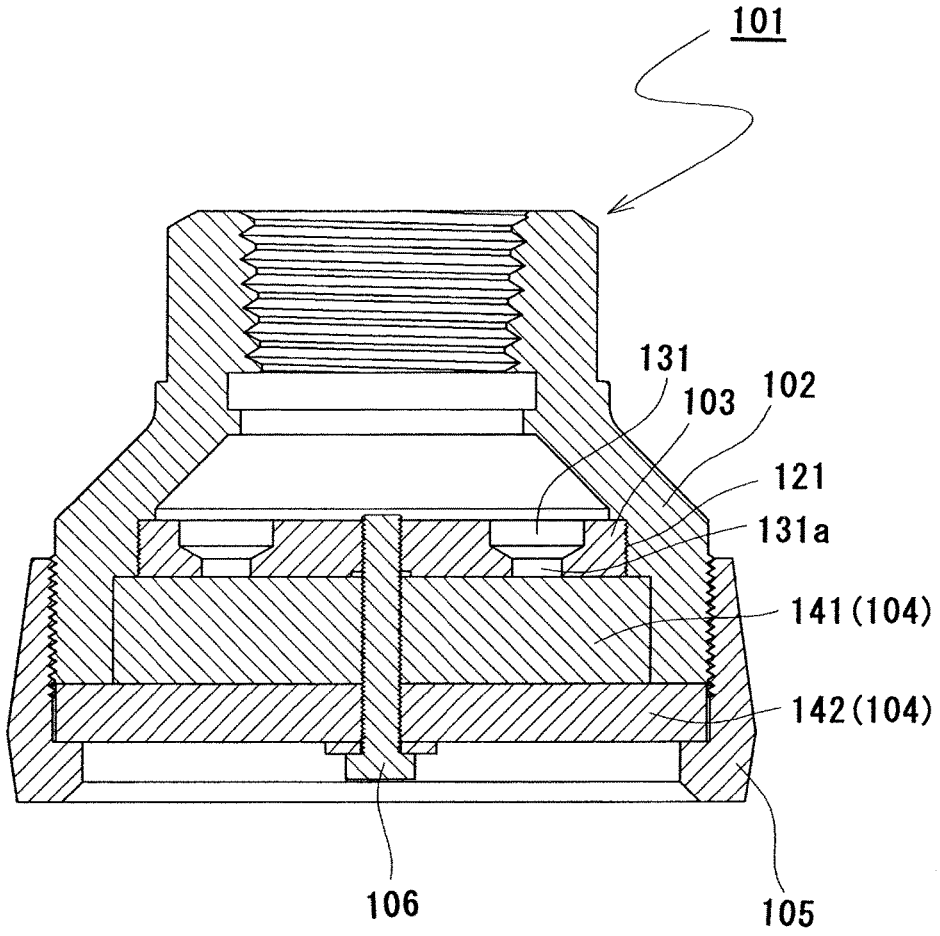
FIG. 21 is an X-X sectional view of FIG. 19.

FIG. 7 shows the relation between injection reaction F of fire-extinguishing gas applied on the injection head at the time of emission of fire-extinguishing gas and flow rate Q of the fire-extinguishing gas released from the injection head, when measured by using nitrogen as fire-extinguishing gas, in three types of injection head (injection head 1 of the embodiment and injection heads 10A, 10B shown in FIGS. 13 (*a*) and (*b*)).

Apparent from the results of measurements shown in FIG. 7, the injection head 1 of the embodiment is lowered in the magnitude of injection reaction F of fire-extinguishing gas applied to the injection head at the time of emission of fire-extinguishing gas to about ⅕ to 1/10, as compared with the conventional injection head.

In the meantime, when carbon dioxide or fluorine compound is used as the fire-extinguishing gas, the value of A is in a relation of nitrogen>fluorine compound>carbon dioxide, but the tendency is same as in FIG. 7.

As a result, the required supporting force of the building accommodating the piping system including the injection head 1 can be decreased, and the problems of limitations of place of installation and cost elevation can be solved.

In the first embodiment, the position of the silencing member 4 through which the bolt 5 penetrates is formed in a shape swollen (protruding) to the outer peripheral side from the other positions. However, as shown in FIG. 8 to FIG. 12, a uniform peripheral shape (cylindrical shape) may be formed as in the second embodiment of the injection head having the silencing function for gas-type fire extinguisher of the present invention.

Other structure and action of the injection head 1 of the second embodiment are the same as in the injection head of the first embodiment.

FIG. 14 to FIG. 21 show a third embodiment of the injection head having the silencing function for gas-type fire extinguisher of the present invention.

The injection head 101 having a silencing function for this gas-type fire-extinguisher is an injection head installed for releasing a fire-extinguishing gas to a fire-extinguishing area in a gas-type fire extinguisher using a fire-extinguishing gas, and includes an injection head main body 102 connected to a piping (not shown) for supplying a fire-extinguishing gas, an orifice plate 103 forming a plurality of orifices 131 disposed detachably at step 121 formed in an internal space of this injection head main body 102, a silencing member 104 of block shapes made of a porous material capable of passing a gas disposed at outlets of the orifices 131, a ring member 105 abutting against the peripheral edge of one-side face released to the atmosphere of the silencing member 104 for supporting the silencing member 104 to the injection head main body 102, and a bolt 106 abutting against the central part of one-side end face released to the atmosphere of the silencing member 104 for supporting the silencing member 104 to the injection head main body 102.

In this case, the orifice plate 103 forming a plurality of orifices 131 is detachably disposed in steps 121 formed in the internal space of the injection head main body 102, for example, by way of screws formed in the peripheral surface of the steps 121 and the orifice plate 103.

As a result, the orifice plate 103 forming plural types of orifices 131 can be selected according to the conditions of the place of installation and others.

In the meantime, by omitting the orifice plate 103, similar orifices can be directly formed in the injection head main body 102 (not shown).

Preferably, the orifices 131 are formed to face the silencing member 104 at the small-end side 131*a* of the orifices 131.

As a result, the fire-extinguishing gas can be distributed uniformly from the central parts of the silencing member 104 toward the peripheral parts, and the noise generated near the emission position of the fire-extinguishing gas can be made uniform, and the noise reduction rate is higher.

The silencing member 105 of block shapes made of a porous material is formed in an integral structure, or, as in the case of this embodiment, is formed in a split structure consisting of an upstream side member 141 and a downstream side member 142.

The porous material composing the silencing member 104 is preferably a sinter material of inorganic material high in shape retaining performance (metal, oxide of meal, hydroxide of metal, etc.).

The pore diameter of gaps in the porous material composing the silencing member 104 is composed of a homogenous material on the whole, or a material changed in the gas passing direction, or more specifically a material reduced in the gas passing direction. For example, in the embodiment, the silencing member 104 is made of a material smaller in the pore diameter of gaps in the downstream side member 142 than the pore diameter of gaps in the upstream side member 141.

Thus, by setting the pore diameter of gaps in the porous material composing the silencing member 104 to be smaller in the gas passing direction, the fire-extinguishing gas can be released uniformly from the parts of the silencing member 104, and the noise generated near the emission position of the fire-extinguishing gas can be made uniform, and the noise reduction rate is higher.

The silencing member 104, whether in integral structure or split structure, is disposed with the end face of other side of the silencing member 104 (the opposite side of the side released to the atmosphere) in contact with the injection head main body 102 (in this embodiment, including the orifice plate 103). The end face of one side of the silencing member 104 (the side released to the atmosphere) is supported on the injection head main body 102 by way of the ring member 105 contacting with the peripheral edge of this end face, and the bolts 106 contact the central parts of the end face.

In this case, the ring member 105 disposed detachably on the injection head main body 102 by way of screw threads formed in the peripheral surface of the injection head main body 102 and the ring member 105.

The downstream side member 142 composing the silencing member 104 is formed in a larger diameter than the upstream side member 141, and the outer peripheral edge of this downstream side member 142 is fixed as being held between the end face of the injection head main body 102 and the peripheral edge of the ring member 105. Therefore, the emission area of the fire-extinguishing gas released to the atmosphere of the silencing member (downstream side member 142) is further increased, and the noise reduction rate can be heightened at the same time.

The bolts 106 are screwed into the orifice plate 103.

As a result, the silencing member 104 can be firmly restrained and supported by the injection head main body 102, and it is possible to use the silencing member 104 large in the passing resistance of fire-extinguishing gas, and high in silencing performance per unit volume, and the noise reduction rate is higher. Hence, the injection head 101 can be reduced in size, and the problems of limitations of place of installation or cost increase can be solved.

Herein, the injection head having the silencing function for gas-type fire extinguisher of the present invention is described by referring to a plurality of embodiments. However, it must be noted that the present invention is not limited to the illustrated embodiments alone, but may be changed or modified in various forms within the true spirit thereof.

INDUSTRIAL APPLICABILITY

The injection head having the silencing function for gas-type fire extinguisher of the present invention has an injection head of a small size, and is capable of enhancing the noise reduction rate, and is moreover capable of reducing the injection reaction of the fire-extinguishing gas applied to the injection head at the time of emission of the fire-extinguishing gas. Hence, the injection head can be used in wide applications of the gas-type fire extinguishers using fire-extinguishing gases such as nitrogen, carbon dioxide, fluorine compound and others, and it can be applied not only in new installations of gas-type fire extinguishers, but also in existing facilities of gas-type fire extinguishers only by exchanging the injection head.

DESCRIPTION OF THE REFERENCE NUMERALS

1 injection head
2 injection head main body
21 step
3 orifice plate
31 orifice
4 silencing member
41 central member
42 peripheral member
43 end member
5 bolt
6 ring member
101 injection head
102 injection head main body
121 step
103 orifice plate
131 orifice
104 silencing member
141 upstream side member
142 downstream side member
105 ring member
106 bolt

The invention claimed is:

1. An injection head having a silencing function for use in a fire extinguisher, comprising:

an injector head main body having an orifice;

a ring member;

a silencing unit for releasing a fire-extinguishing gas in a fire-extinguishing area, said silencing unit including a silencing member at an outlet end of said orifice, said silencing member having a block shape and being made of a porous material to allow the fire-extinguishing gas to pass therethrough, a diameter of pores of said porous material of said silencing member decreasing along a flow direction through said silencing member along which the fire-extinguishing gas flows, said silencing member being configured to have:

a first end face contacting said injector head main body, a second end face opposite said first end face and opened to atmosphere except for a peripheral end portion of said second end face of said silencing member contacting said ring member, and a peripheral face between said first end face and said second end face, said peripheral face opened to atmosphere; and said silencing member being composed of:

a central member, a peripheral member, and an end member covering an end face of said central member and an end face of said peripheral member, wherein a pore diameter of pores of said peripheral member and said end member is smaller than a pore diameter of pores of said central member;

a bolt for fixing said ring member and said silencing member to said injector head main body, said bolt penetrating through a peripheral portion of said silencing member.

2. The injection head according to claim 1, wherein said bolt penetrates through an inside of said silencing member, and said bolt is screwed into said injector head main body.

3. The injection head according to claim 2, wherein said bolt penetrates through a bolt receiving portion of said silencing member, said bolt receiving portion protruding radially outward relative to main portions of said silencing member.

4. The injection head according to claim 1, wherein said injector head main body includes a detachable orifice plate having said orifice.

5. The injection head according to claim 1, wherein said orifice has a narrow end facing said silencing member.

6. The injection head according to claim 1, wherein said injector head main body, said ring member, and said silencing member are configured such that an injection reaction F of the fire-extinguishing gas applied on said injection head at a time of emission of fire-extinguishing gas, and a flow rate Q of the fire-extinguishing gas released from said injection head satisfy a relation of formula 1 and formula 2

$$F\ (\text{kgf}) = A\ (\text{kgf}\cdot\text{min/m}^3)\cdot Q\ (\text{m}^3/\text{min}) \quad \text{(formula 1)}$$

$$A\ (\text{kgf}\cdot\text{min/m}^3) \leq 0.2 \quad \text{(formula 2).}$$

7. An injection head having a silencing function for use in a fire extinguisher, comprising:

an injector head main body having an orifice;

a silencing unit for releasing a fire-extinguishing gas in a fire-extinguishing area, said silencing unit including a silencing member at an outlet of the orifice, said silencing member having a block shape and being made of a porous material to allow the fire-extinguishing gas to pass therethrough, a diameter of pores of said porous material of said silencing member decreasing along a flow direction through said silencing member along which the fire-extinguishing gas flows, said silencing member being composed of:

an upstream side member; and a downstream side member, wherein a pore diameter of pores of said downstream side member is smaller than a pore diameter of pores of said upstream side member;

said silencing member being arranged such that an end face of said silencing member open to atmosphere is supported on said injector head main body by a threaded ring member contacting a peripheral portion of said end face of said silencing member and by a bolt contacting a central portion of said end face of said downstream side member of said silencing member.

8. The injection head according to claim 7, wherein said threaded ring member has screw threads threading on to said injector head main body.

9. The injection head according to claim 7, wherein said injector head main body includes a detachable orifice plate having said orifice and contacting a first end face of said silencing member, said end face comprising a second end face, and said bolt is screwed into the orifice plate.

10. The injection head according to claim 7, wherein said orifice has a narrow end facing said silencing member.

* * * * *